US007572966B1

(12) United States Patent
Frigo et al.

(10) Patent No.: US 7,572,966 B1
(45) Date of Patent: Aug. 11, 2009

(54) THEMED HAND HELD PERSONAL NOISEMAKING INSTRUMENT

(76) Inventors: Peter Frigo, 100 E. Bayaud Ave., Apt 403, Denver, CO (US) 80209; Anthony Bartels, 104 Princeton Rd., Fort Collins, CO (US) 80525

( * ) Notice: Subject to any disclaimer, the term of this patent is extended or adjusted under 35 U.S.C. 154(b) by 0 days.

(21) Appl. No.: 12/177,957

(22) Filed: Aug. 21, 2008

(51) Int. Cl.
*G10D 13/08* (2006.01)

(52) U.S. Cl. ..... 84/402

(58) Field of Classification Search ..... 84/411 R, 84/402–410; 446/265, 268, 297, 318
See application file for complete search history.

(56) References Cited

U.S. PATENT DOCUMENTS

D196,184 S * 9/1963 Renzi ..... D21/406
6,146,236 A 11/2000 Kay
D459,382 S 6/2002 Cohen
D459,749 S 7/2002 Cohen
D459,750 S 7/2002 Cohen
D463,482 S 9/2002 Cohen
6,736,695 B1 5/2004 Hoch
6,817,922 B1 11/2004 Davies
6,838,606 B2 1/2005 Chiang
7,163,431 B2 1/2007 Walraven
2007/0060014 A1 3/2007 Hoch

* cited by examiner

*Primary Examiner*—Kimberly R Lockett
(74) *Attorney, Agent, or Firm*—Leyendecker & Lemire, LLC; Kurt Leyendecker

(57) ABSTRACT

Embodiments of the present invention comprise themed hand-held drums configured to be representative of a particular theme, such as an event or entity. The hand-held drums serve as both a means to generate noise or sound during an event in support of the event and/or an entity or team participating in the event but also as souvenirs, mementos or keepsakes that remind the user of the entity or event.

20 Claims, 4 Drawing Sheets

THEMED HAND HELD PERSONAL NOISEMAKING INSTRUMENT

FIELD OF THE INVENTION

The invention relates to a hand-held drum typically used at sporting events or other large gatherings by spectators.

BACKGROUND

Sporting events, such as baseball, basketball, football, hockey and soccer, are often held in arenas or stadiums in front of large crowds. It is common at these sporting events for the crowd to make as much noise as possible to either show support for their team and/or attempt to distract or rattle one or more players on an opposing team. Traditionally, spectators make noise by yelling, clapping their hands or stomping their feet. On occasion, mechanical noise makers, such as rattles, have been used as well.

Additionally, crowds may participate in again through the use of visual items. For instance, and baseball it is not uncommon for a home team to hand out small towels emblazoned with the team logo. These towels are shook en mass at certain times during a game to rally the home team. Both visual items and noisemakers often serve as souvenirs a spectator may take home after the sporting event. When these items are configured with the team's insignia, the spectator may display them in his or her office residence.

DETAILED DESCRIPTION

Figure 1:
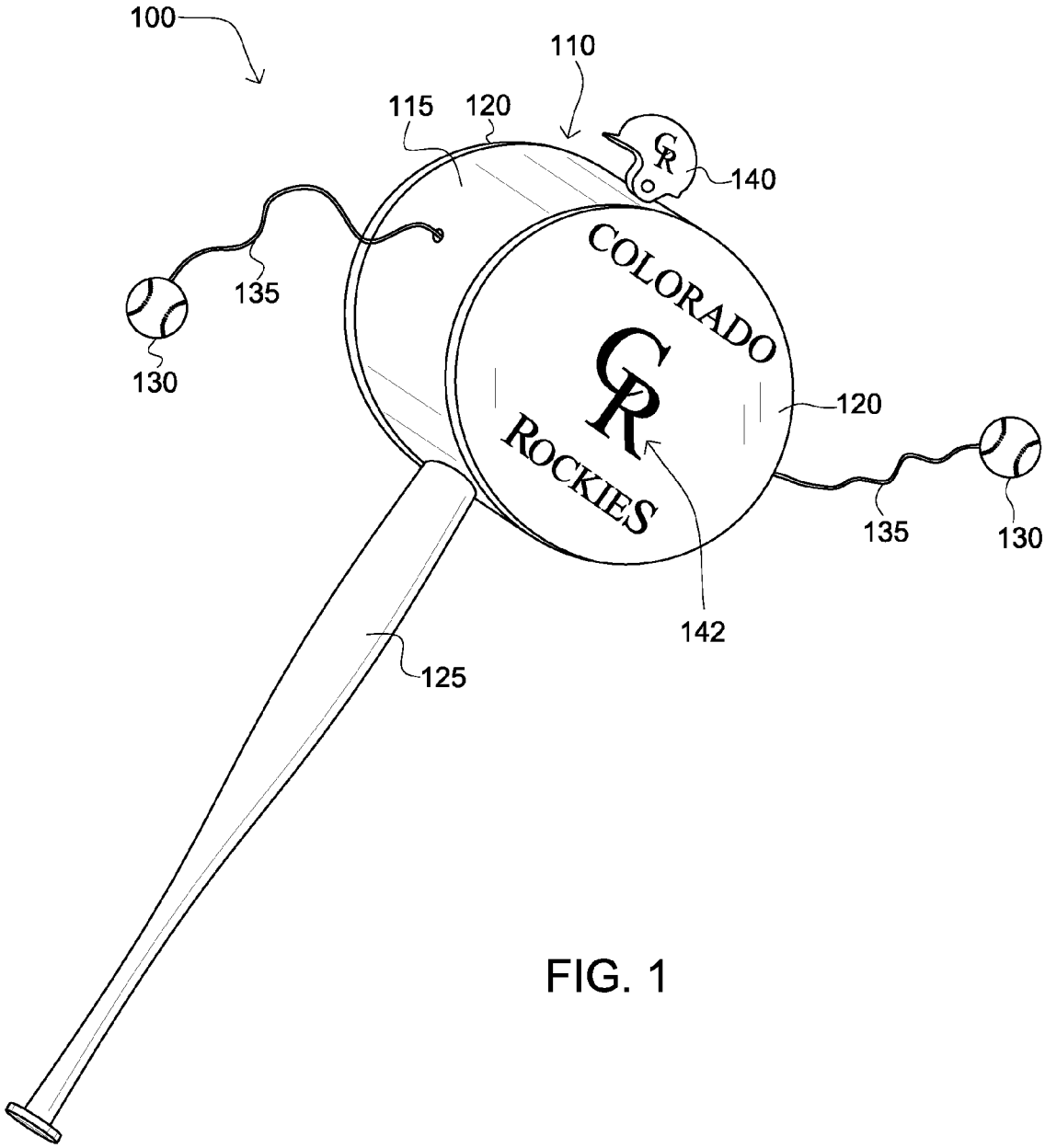
FIG. 1 is an isometric illustration of a drum-type noisemaker according to an embodiment of the invention.

Hand-held drums are noisemakers comprising an elongated handle that can be pivoted or rotated back in forth between the hands of a user. A drum head is secured to the distal end of the handle. The drum head typically has two opposing striking surfaces separated by a generally cylindrical body. Coupled with the cylindrical body most typically by way of a flexible string are a pair of strikers that when the handle is rotated or pivoted back and forth cause the strikers to alternatively strike the striking surfaces and generate a sound.

Embodiments of the present invention comprise hand-held drums configured to be representative of a particular event or entity. Accordingly, these hand-held drums serve as both a means to generate noise or sound during an event in support of the event and/or a entity or team participating in the event but also as souvenirs, mementos or keepsakes that remind the user of the entity or event.

For example, one embodiment of the hand-held drum includes indicia on the striking surfaces of a baseball team and the strikers comprise miniature baseballs. This embodiment may be available for purchase or be handed out as a promotion at a baseball game in which the particular baseball team is playing. By using the hand-held drum during the game, the supporters of the team can generate noise en mass at certain desirable instances. In certain embodiments that noticeably display the team colors, the view of hundreds if not thousands of hand-held drums being held up at the same time can create quite a spectacle to television viewers and viewers on an opposing side of a stadium. After the game, the users of the drum can take it home keeping it as a memento of the game.

Certain embodiments and variations can be festooned with other items representative of an entity or event. For example concerning the baseball team hand-held drum, the handle can comprise a miniature baseball bat and/or a miniature baseball helmet can be secured to the top of the drum head.

While one of the uses of the hand-held drum described herein is in relation to sporting events, variations of the hand-held drum can be produced for other events and occasions as well. For instance, customized hand-held drums can be produced for political party candidates or for the particular candidates. Other customized variations can be utilized at musical concerts or even theater as a means to get the audience involved in an event. Further, drums can be customized to commemorate and celebrate a special event such as an important anniversary of an entity even absent an associate mass attendance event.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

As used herein the term "indicia" refers to intentional markings appearing on an associated article. The markings can comprise alphanumeric characters, logos and/or other graphical representations. The marks can be printed on the article, affixed with an appliqué, integrally fabricated on the surface of the article and/or applied to the article in any suitable manner.

As used herein the term "string" refers to an elongated member having a significant length relative to its width that is substantially flexible along its length. "String" may be comprised of one or more fibers but as used herein it can also comprise a flexible wire, cable or chain.

As used herein "equipment" refers to articles utilized or regularly or generally associated with a particular event or entity. For instance, "sports equipment" would typically comprise those articles used in the playing of a sport but also other articles or items usually associated with the particular sport including for instance a mascot of a particular team that plays the sport.

A First Embodiment of a Themed Hand-Held Drum

Figure 2:
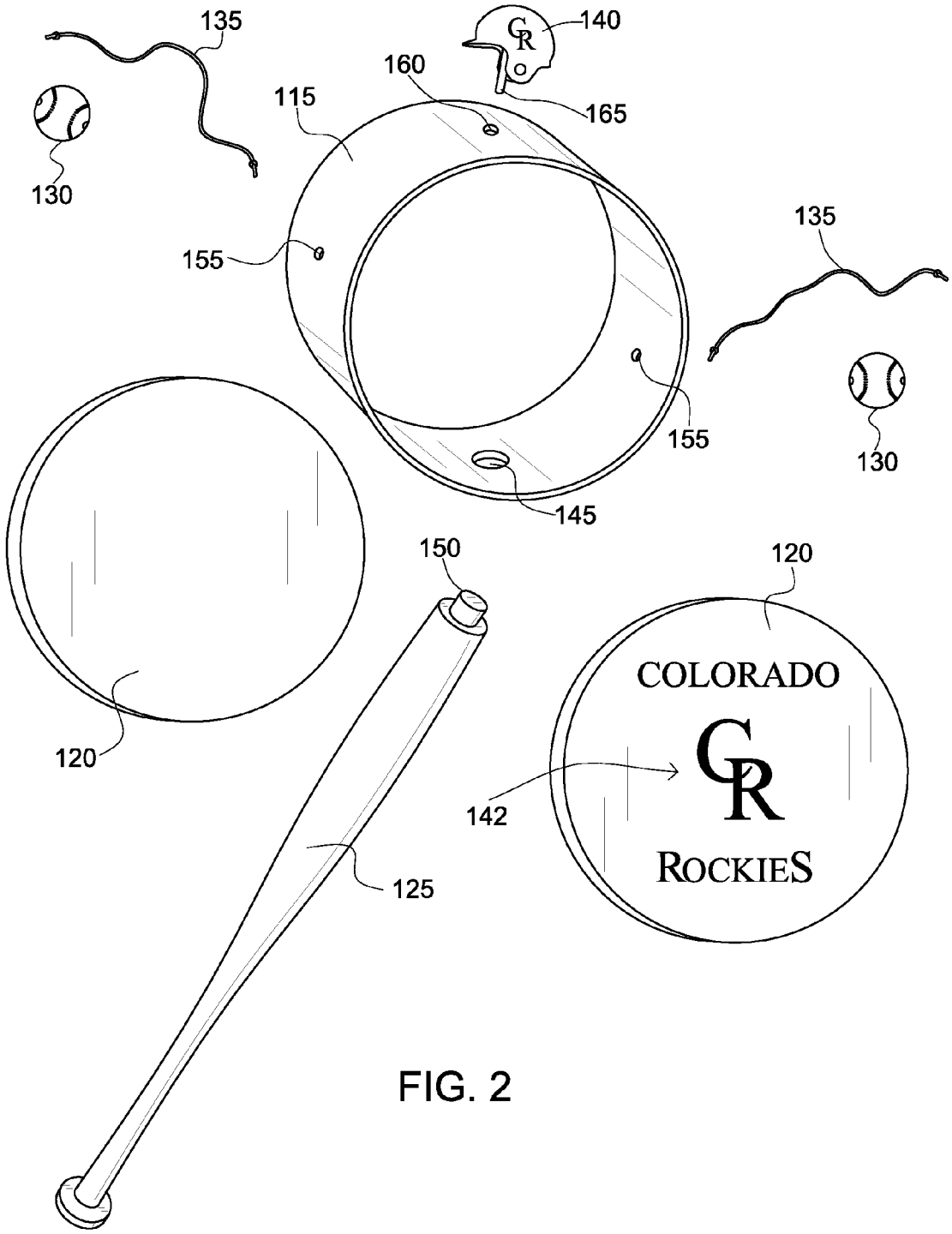
FIG. 2 is an isometric exploded view of the noisemaker of FIG. 1 according to an embodiment of the invention.

Referring primarily to FIGS. 1 and 2, a baseball-themed hand-held drum embodiment 100 is illustrated. It is to be appreciated that the illustrated embodiment includes a variety of thematic elements that need not be included in every variation. For instance, one variation can include a miniature baseball helmet top piece 140 located on a top of the drumhead 110; whereas, and another variation may not include this particular feature. Yet another variation can include the themed strikers 130 and drum faces 120; but include neither the baseball bat handle 125 nor the baseball helmet top piece.

Generally, embodiments of a hand-held drum whether the version illustrated in the first embodiment 100 or in the other embodiments 200-500 included herein comprises (i) a drumhead 110 with indicia provided on one or both of the opposing drum faces 120, (ii) a pair of opposing strikers 130 that resemble an item or piece of equipment associated with the particular theme of the hand-held drum, (iii) two pieces of string 135 that couple the strikers to the drumhead, and (iv) an elongated handle 125 that extends downwardly from the drumhead and can in certain variations resemble an element, item or piece of equipment associated with the theme. On some variations, a top piece 140 that is secured to the top of the drumhead generally opposite the handle can also be provided.

To generate a rhythmic sound using the drum 100, a user rotates or pivots the handle 125 typically held between his or her hands back and forth. Accordingly, the strikers 130 swing back and forth alternately hitting the opposing drum faces or striking surfaces 120.

Figure 3:
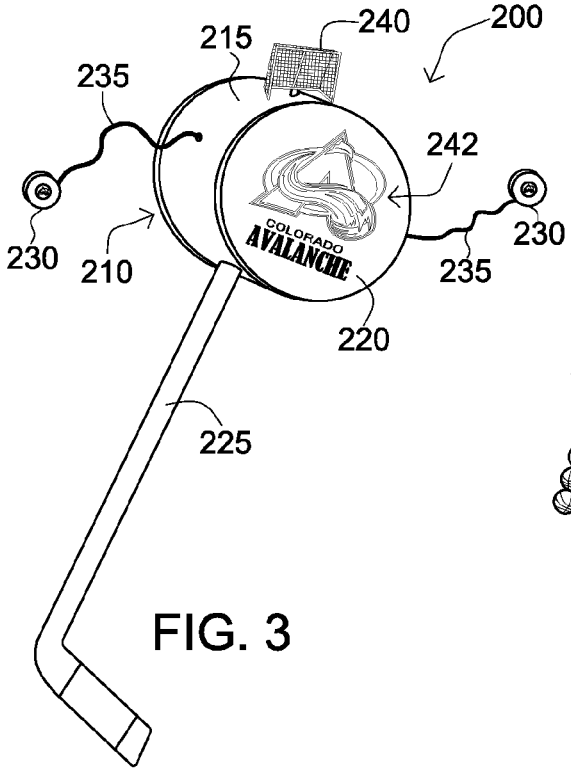
FIGS. 3-6 are isometric illustrations of noisemakers according to various embodiments of the invention.

As a general note, the various elements illustrated in the various figures are identified by a three digit number. Each element in an illustrated embodiment includes the same first digit but these first digits differ for similar or corresponding items or elements depicted in the other illustrated embodiments. For example, the first embodiment comprising a baseball-themed hand-held drum 100 is illustrated with its elements being numbered in the 100s; whereas, the second embodiment 200 as illustrated in FIG. 3 has its elements numbered in the 200s. However, where the last two digits are similar across embodiments, they indicate elements or features having commonality with each other. For instance, the baseball helmet element, which is located on top of the drumhead 110, is identified as "140" and a similarly located goal on the hockey themed second embodiment 200 is identified as "240". Accordingly, it is to be appreciated that the description included in this section relative to the first embodiment with its elements numbered in the 100s is to be considered applicable to the various other embodiments having different first digits but similar second and third digits.

Referring back to FIGS. 1 and 2, the drumhead 110 typically comprises a cylindrical and tubular body portion 115 that includes a single circumferential sidewall. A typical body is comprised of a polymeric material, such as Acrylonitrile-Butadiene-Styrene (ABS); however, numerous other suitable materials may be utilized, such as wood or metal. The sound generated by the hand-held drum 100 is often affected by the material choice and the thickness of sidewall. While a cylindrical body portion is perhaps the most common type utilized, body portions comprising any other cross-sectional shapes, such as rectangular, triangular, pentagonal and octagonal, are also contemplated.

Attached to either open end of the body 115 are opposing drum faces 120 (also referred to herein as striking services). The drum faces span and effectively close off the interior space of the body portion. The drum faces can be made of any suitable material that when struck by a striker 130 resonates and creates a sufficiently loud and robust sound. Some typical materials used to fabricate the drum faces include treated paper, animal skins and tensioned plastic sheet, although other materials as would be obvious to one of ordinary skill in the art may be utilized as well. The drum faces are attached to the body using any suitable means, such as but not limited to mechanical fastening, adhesive bonding and even tensioning by way of tightly threaded cords spanning between the opposing faces around the circumference of the body.

The surface of the drumhead 110 can be adorned in any suitable fashion and in any desirable color. Typically, the drum body 115 and the drum faces 120 are provided in colors relevant to the team, entity or event that the associated hand-held drum 100 represents. For instance, the first embodiment hand-held drum of FIGS. 1 & 2 pertains generally to baseball and baseball teams but the variation shown for illustrative relates specifically to the Colorado Rockies™ baseball club. Accordingly, the body and drum faces would typically be finished in one or more of purple, black and silver, the Colorado Rockies' team colors. Similarly, in a variation that pertains to the Boston Redsox™, the body and faces would typically be finished in red, white, grey and/or navy blue.

The drum faces 120, and in some variations the sidewalls of the drum body 115, are adorned with indicia that pertains to the theme of the particular drum 100. For instance, a baseball team themed drum will typically include indicia 142 of one or more of a team's logo and name on one or more of the striking surfaces. If the drum is themed to celebrate a particular player, the indicia can comprise the player's name and number or even a photo or caricature of the player.

Several partial or through bores 145, 155 & 160 (or holes) are typically provided at various locations on the face of the body 115 that facilitate the attachment of various elements to the drumhead 110. On the bottom of the drumhead at the sidewall most often at a location in between the opposing drum faces 120 an opening or partial bore 145 is provided to interface with a protrusion 150 located on a distal end of the elongated handle 125. The protrusion is received into the bore and secured by any suitable means including friction, fusion, such as when the handle and body comprise similar thermoplastic materials, and adhesive bonding. While for ease of manufacture the bore is most often circular, variations are contemplated wherein the bore is oval, rectangular or some other shape that will naturally inhibit a similarly shaped protrusion from twisting or spinning therein.

On some variations, the handle 125 is configured to resemble a piece of equipment or other element representative of the event or entity. For instance, as shown in FIGS. 1 & 2, the handle of a baseball-themed hand-held drum 100 can comprise a miniature baseball bat. Preferably, the handle will be rounded, at least along part of its length, to facilitate ease of pivoting the handle between the hands of a user; however, the handle can in some variations have other cross sectional shapes, such as rectangular or polygonal.

The handle 125 can be made from any suitable material although wood and plastic handles are most typically used as these materials are easily formed into the desired shapes and are cost effective.

Generally opposite the handle bore, an accessory bore 160 can be provided to receive and secure a protrusion 165 extending from a top piece 140 to the top of the body 115. In other variations, the top item or element can be secured directly to the sidewall such as by adhesive bonding. The top piece will typically represent a piece of equipment, a mascot or some other representation related to the event or entity to which the drum pertains.

The top element or top piece 140 is usually but not necessarily comprised of plastic and is injection molded. Accordingly, miniatures incorporating a significant amount of detail can be fabricated very inexpensively. The top pieces can be molded using colored plastic, painted or both. Often the protrusion 165 will be integrally molded into the pieces to interface with the accessory bore as mentioned above.

Additionally, opposing openings 155 are typically provided halfway between the top and bottom locations of the sidewall in order to receive the ends of the strings 135 to which the opposing strikers 130 are attached. The appropriate ends of the string are typically knotted such that the knots are larger than the respective openings. The knot on each string is positioned on the interior of the cylindrical body 115 with the remainder of the string passing through its respective opening so that the string is retained in place during use.

Strikers 130 are secured to the distal ends of the strings 135. Most typically, the strikers have holes or bores that pass through them. It is through these bores that the distal end of each string is received and the distal end is often knotted to retain the striker thereon during use. As can be appreciated, however, the strikers can be secured to the strings by any other suitable means such as mechanical fastening and adhesive bonding.

The strings 135 are typically of suitable length so that when the user pivots the handle between his/her hands, the strikers swing and alternatively strike the opposing striking surfaces 120 generally proximate their centers. To facilitate the free movement of the strikers the strings are lightweight and flexible.

The strikers 130 are most often comprised of a plastic material giving them enough weight that when they strike the striking surfaces they impart enough force to make a sufficiently loud sound. The strikers can also be comprised of other materials such as wood or metal in variations. Most notably, the strikers typically resemble an item associated with the theme of the hand-held drum 100 to which they are part. For instance, on the baseball team themed hand-held drum of FIGS. 1 & 2, the strikers resemble baseballs. In other variations, the strikers can comprise miniature renditions of team mascots or the mascots head, or even miniature batting helmets. In yet other variations, the strikers can comprise appropriately configured charms that represent any object related to the theme of a particular hand-held drum.

For similar reasons as the top pieces 140, the strikers 130 are often comprised of an injection molded plastic and can be wholly or partially painted. In other variations, especially those wherein the strikers are substantially spherical, they can be fabricated from wood, glass, clay or ceramic beads as well. The striker bores or holes to which the associated strings are attached can be integrally molded with the striker or mechanically formed therein later.

A Second Embodiment of a Themed Hand-Held Drum

Referring to FIG. 3, a hockey team themed hand-held drum 200 is illustrated. For illustrative purposes only, the illustrated indicia 242 comprise the logo of the Colorado Avalanche™ professional hockey team. The remainder of the drumhead 210 can be adorned in the team's colors.

The two opposing strikers 230 consist of miniature hockey pucks attached to the body 215 by way of pieces of string 235. The miniature pucks can be adorned with indicia relating to a particular team, the league or hockey in general. As illustrated, the appropriate ends of the strings are attached to the pucks along their sidewalls such that the face of the pucks strike the drum faces 220; however in variations the string ends can be attached to one or more faces of the pucks such that the sidewall edges of the puck strike the drum faces during use.

As illustrated, a handle shaped like a hockey stick 225 is provided. The blade of the stick can be located at the distal end of the handle as shown or the blade portion can interface with the drumhead in other variations. It is noted that the shaft of a typical hockey stick is typically rectangular in cross section; however, in certain variations of this embodiment a portion of the shaft can be rounded to facilitate a user's ability to quickly rotate or pivot the drum in his/her hands during use. The hockey stick can be marked with suitable indicia.

A top piece is also provided resembling a hockey net 240. Other top pieces can be provided in place of the net including but not limited to a goalie helmet, a three dimensional depiction of the logo, and/or a depiction of a trophy, such as the Stanley Cup.

Many variations of the hockey-themed hand-held drum are contemplated. For instance, certain variations can be produced without a top piece 240 and/or a dowel for a handle in place of a miniature hockey stick 225. Similarly, the strikers might represent other pieces or elements such as miniature hockey sticks, hockey gloves or goalie helmets.

A Third Embodiment of a Themed Hand-Held Drum

Figure 4:
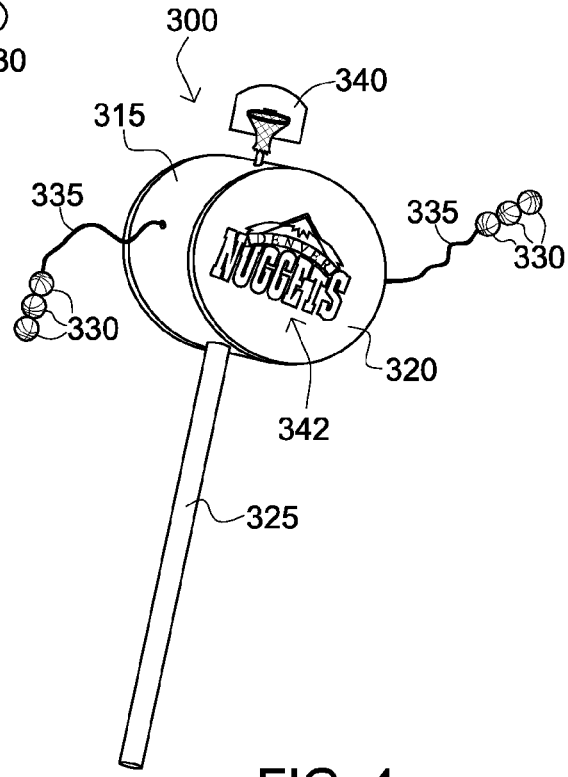

Referring to FIG. 4, a basketball team themed hand-held drum 300 is illustrated. For illustrative purposes only, the illustrated indicia 342 comprise the logo 320 of the Denver Nuggets™ professional basketball team. The remainder of the drumhead 310 can be adorned in the team's colors.

The two opposing strikers 330 consist of miniature basketballs attached to the body 315 by way of pieces of string 335. The basketballs can be adorned with indicia relating to a particular team, the association or league or basketball in general. Unlike the previous two embodiments; however, each piece of string includes more than one striker threaded thereon. Specifically in this embodiment, three miniature basketball strikers are provided on each string; however, the number can vary including a variation wherein the entire string is essentially covered in strikers. In yet other variations, the strikers can represent different objects or similar objects that are rendered differently. For example, the colors of the basketballs could alternate. In another example, the strikers could comprise miniature likenesses of the faces or heads of various starters on a particular team. Of course, the multiple striker variations need not be limited to basketball-related embodiments but can be applied to any themed hand-held drum.

A simple cylindrical handle 325 is provided on a bottom side of the drumhead 315 and a top piece 340 resembling a net and backboard extends from the top side of the drumhead. Accordingly, the combination of the handle and the top piece can be configured to resemble a basket ball net assembly that appears to pierce and extend through the drumhead. The handle 325 and/or the top piece 340 (for instance the backboard portion) can be marked with suitable indicia as well.

Many variations of the basketball-themed hand-held drum are contemplated. For instance, certain variations can be produced without a top piece 340. In other variations, the top piece could comprise the bust of a player who is being honored.

A Fourth Embodiment of a Themed Hand-Held Drum

Figure 5:
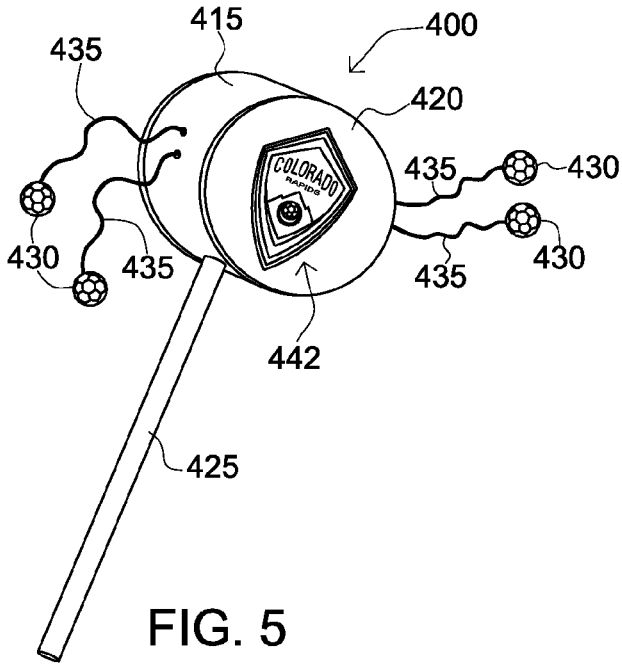

Referring to FIG. 5, a soccer team themed hand-held drum 400 is illustrated. For illustrative purposes only, the illustrated indicia 442 comprise the logo 420 of the Colorado Rapids™ professional soccer team. The remainder of the drumhead 410 can be adorned in the team's colors.

As shown each side of the body has two strings 435 with strikers 430 attached extending therefrom. The strikers 430 comprise miniature soccer balls. The soccer balls can be adorned with indicia relating to a particular team, the association or league or soccer in general. As described above in relation to the basketball themed embodiment, the strikers can all be similar or they can represent different objects. Further, other variations are contemplated wherein two or more sets of strings and strikers are provided on each side of the body for any themed hand-held drum.

A simple cylindrical handle 425 is provided on a bottom side of the drumhead 415. The handle 425 can be marked with suitable indicia. Unlike the other illustrated embodiments, no top piece is provided.

Variations of the soccer-themed hand-held drum are contemplated. For instance, certain variations can be produced with a top piece 440, such as one that resembles a soccer ball or a goal.

A Fifth Embodiment of a Themed Hand-Held Drum

Figure 6:
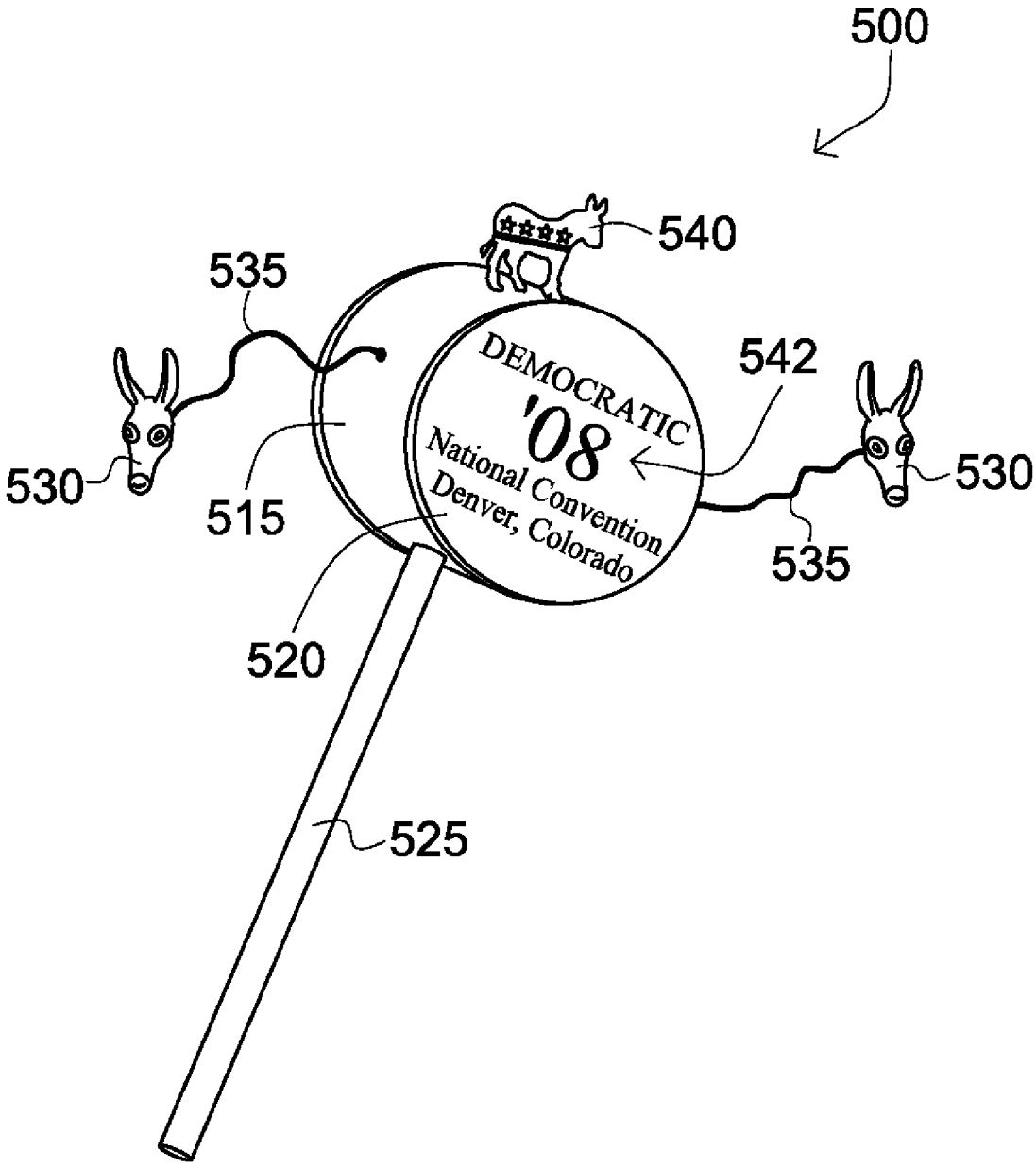

All the foregoing illustrated embodiments pertain to sports or sports teams. However, embodiments are contemplated that commemorate and/or pertain to other types of entities and events. FIG. 6, which comprises a drum 500 commemorating the 2008 Democratic National Convention, is an example of just one of many non-sports related hand-held drums. Of course, hand-held drums can be themed for any suitable event or entity including but not limited to conventions in general, concerts, festivals and carnivals, celebrities, politicians, companies, and weddings. The applicability of a themed hand-held drum to a particular event is left to the imagination of persons having the benefit of this disclosure.

The Democratic National Convention themed hand-held drum 500 includes drum faces 520 that include indicia 542 announcing or commemorating the convention. In variations, the names or images of the candidates on the Democratic ticket might be portrayed. The drumhead and body 515 are likely to be rendered in the colors of the party's candidate. A traditional round handle 525 is illustrated although suitable themed handles can be substituted in variations. Strikers 530 resembling the heads of donkeys, the mascot of the party are provided attached to flexible strings 535. Finally, a miniature donkey top piece 540 is provided although as with the other elements other suitable top pieces can be provided. For instance a top piece that resembles a mountain range can be provided to commemorate that the convention was held in Denver, Colo.

A Method of Audience Participation in a Mass Attendance Event

The hand-held drums described and illustrated herein can be used individually; however, when a large number of drums are sounded en masse, the result can be both visually and audibly stimulating. Accordingly, the drums are suitable for use in mass attendance events such as but not limited to sporting events.

When operated in unison either in a synchronized fashion or randomly from user to user, the drums can collectively create a significant amount of sound which an audience can use to make their presence known during an event. Further, since drums handed out an event are likely to be similar in appearance, such as having the same color, a multitude of drums being held up and operated simultaneously by people in relatively close quarters, such as in a stadium, the visual appeal can be stimulating as well. Drums of differing colors can even be provided in a predetermined fashion such than when operated en mass a symbol, logo, advertisement, and/or words are displayed.

For mass audience use of a themed hand-held drum to be most effective, it is necessary that a significant portion of an audience, most desirably those sitting in close proximity to each other, be in possession of the drums. One manner to accomplish such a distribution is to hand out the themed drums to attendees as they enter a stadium as a giveaway.

At various times during a game when audience participation is deemed desirable, the drum carrying spectators can be enticed to generate sound from the drums. For instance, an image of a hand-held drum can be displayed on a large scoreboard screen in the stadium wherein the users are encouraged to make noise. The display can also be animated showing the strikers pivot back and forth between drum heads such that the users can synchronize their drums with the image and each other.

ALTERNATIVE EMBODIMENTS AND VARIATIONS

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention. For instance, numerous variations are contemplated concerning the configuration of the strikers and strings attaching the strikers to the drum body. In one variation that is not illustrated a single string is attached to opposing sides of the body that divides into two or more fingers at its distal end wherein a striker is attached to each end of the fingers. As with the other multiple striker variations described herein, each striker can comprise the same charm or represent different charms having applicability to the drum's theme.

We claim:

1. A personal noisemaker comprising:

a drum head, the drum head including an outwardly facing first striking surface spaced from and generally parallel with an outwardly facing opposing second striking surface with one or more sidewalls extending between the striking surfaces, at least one striking surface including indicia pertaining to a professional team or player that participates in a sport;

at least one string having first and second ends, the first end being secured to a sidewall of the one or more sidewalls;

at least one striker, the striker being secured to the at least one string proximate the second end, the striker comprising a miniature facsimile of a piece of equipment used in the play of the sport; and an elongated handle, the handle being secured to a sidewall of the one or more sidewalls;

whereby oscillating pivotal movement of the handle by a hand of a user along a longitudinal axis of the handle causes the strikers to alternately impact the first and second striking surfaces and generate sound.

2. The noisemaker of claim 1, wherein indicia pertaining to the professional team is provided on both the first and second striking surfaces.

3. The noisemaker of claim 2, the indicia comprises one or more of: a team name; a team logo; a depiction of a team mascot; a jersey number, a team's city; and a name of a player.

4. The noisemaker of claim 1 wherein colors of the drum head substantially comprise team colors.

5. The noisemaker of claim 1 wherein the at least one string and the at least one striker comprise first and second strings with first and second strikers being coupled to the respective second ends of the strings, the first end of the second string being secured to a sidewall of the one or more sidewalls at a second location generally opposite a first location wherein the first end of the first string is secured to a sidewall of the one or more sidewalls.

6. The noisemaker of claim 1, wherein the at least one striker comprises the miniature facsimile of one of a football, a baseball, a basketball, a soccer ball, a hockey puck, a football helmet, a baseball helmet, a hockey helmet, a soccer cleat, a hockey skate, a goal post, a golf ball, a tennis ball, a tennis racket and a baseball bat or any other facsimile used in the play of the sport depicted.

7. The noisemaker of claim 1, wherein the handle comprises a miniature facsimile of a second piece of equipment used in the play of the sport.

8. The noisemaker of claim 7, wherein the second piece of equipment pertains to the same sport as the first piece of equipment and the handle resembles a baseball bat, a hockey stick, a football or soccer goal post, a lacrosse stick, a tennis racquet or a golf club.

9. The noisemaker of claim 1, wherein the drum head further includes a top location on a sidewall of the one or more sidewalls opposite a location wherein the handle is secured to the a sidewall of the one or more sidewalls and further comprising a miniature facsimile of a third piece of equipment mounted thereto, the third piece of equipment pertaining to the same sport as the first piece of equipment.

10. The noisemaker of claim 9, wherein the third piece of equipment comprises a hockey helmet, a football helmet, a baseball, a baseball helmet/cap, a football, a soccer ball, basketball basket or goalposts.

11. A hand-held drum comprising:

a drum head having opposing and spaced striking surfaces and one or more sidewalls spanning between the striking surfaces, the opposing striking surfaces having indicia appearing thereon, the indicia being representative of a particular theme;

an elongated handle extending outwardly from the one or more sidewalls;

a pair of strings secured to and extending from opposing locations on the one or more sidewalls; and at least a pair of strikers, a first striker being attached to an end of the first string of the pair of strings and a second striker being attached to an end of the second string of the pair of strings, at least one striker comprising a first miniature representation of an item associated with the particular theme.

12. The hand-held drum of claim 11, wherein the theme comprises an entity and the entity includes one of a sports team, a country, an educational institution, a state, a city, a company and a social club.

13. The hand-held drum of claim 11, wherein the particular theme comprises an event and the entity includes a convention, a sporting event, a festival, a circus, a carnival, a mass participation event or a mass spectator event.

14. The hand-held drum of claim 11, wherein the handle comprises a miniature representation of a second item associated with the particular theme.

15. The hand-held drum of claim 11, wherein a miniature representation of a third item associated with the particular theme is mounted to the one or more sidewalls at a location generally opposite the location of the handle.

16. The hand-held drum of claim 11, wherein the indicia comprises printing.

17. The hand-held drum of claim 11, wherein the indicia comprises a holographic image.

18. A method of mass spectator participation at a sporting event, the method comprising;

providing a plurality of hand-held drums to plurality of spectators at a sporting event, each hand-held drum comprising (i) a drum head, the drum head including an outwardly facing first striking surface spaced from and generally parallel with an outwardly facing opposing second striking surface with one or more sidewalls extending between the striking surfaces, at least one striking surface including indicia pertaining to a professional team or player that participates in a sport, (ii) two strings, each having first and second ends, the first end of each being secured to a sidewall of the one or more sidewalls, (iii) two strikers, each striker being secured to a string of the two strings proximate the second end, the strikers comprising miniature facsimiles of pieces of equipment used in the play of the sport, and (iv) an elongated handle, the handle being secured to a sidewall of the one or more sidewalls; and directing the plurality of spectators to oscillating the handle by a hand of a user along a longitudinal axis of the handle causes the strikers to alternately impact the first and second striking surfaces and generate sound.

19. The method of claim 18, further comprising directing the plurality of spectators to hold up the hand-held drum in unison with one of the striking surfaces facing outwardly.

20. The method of claim 19, wherein said providing a plurality of hand-held drums to plurality of spectators further comprises giving the hand-held drums to the plurality spectators upon entrance to the arena or stadium in which the sporting event is to take place.

* * * * *